US011248468B2

(12) United States Patent
Paquin et al.

(10) Patent No.: US 11,248,468 B2
(45) Date of Patent: Feb. 15, 2022

(54) TURBINE BLADE HAVING AN IMPROVED STRUCTURE

(71) Applicant: SAFRAN, Paris (FR)

(72) Inventors: Sylvain Paquin, Moissy-Cramayel (FR); Romain Pierre Cariou, Moissy-Cramayel (FR); Thomas Michel Flamme, Moissy-Cramayel (FR); Adrien Bernard Vincent Rollinger, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 16/604,103

(22) PCT Filed: Apr. 10, 2018

(86) PCT No.: PCT/FR2018/000080
§ 371 (c)(1),
(2) Date: Oct. 9, 2019

(87) PCT Pub. No.: WO2018/189433
PCT Pub. Date: Oct. 18, 2018

(65) Prior Publication Data

US 2020/0040741 A1 Feb. 6, 2020

(30) Foreign Application Priority Data

Apr. 10, 2017 (FR) ..... 1700389

(51) Int. Cl.
*F01D 5/14* (2006.01)
*F01D 5/18* (2006.01)

(52) U.S. Cl.
CPC ..... *F01D 5/147* (2013.01); *F01D 5/189* (2013.01); *F01D 5/188* (2013.01)

(58) Field of Classification Search
CPC ..... F01D 5/147; F01D 5/182; F01D 5/188; F01D 5/189; F05D 2260/2212
See application file for complete search history.

(56) References Cited

U.S. PATENT DOCUMENTS 3,781,129 A * 12/1973 Aspinwall ..... F01D 5/189 416/97 R
3,846,041 A 11/1974 Albani
(Continued)

FOREIGN PATENT DOCUMENTS

CN 1715618 A 1/2006
CN 103089326 A 5/2013
(Continued)

OTHER PUBLICATIONS

International Search Report and Written Opinion dated Nov. 6, 2018, in International Application No. PCT/FR2018/000080 (6 pages).
(Continued)

*Primary Examiner* — Courtney D Heinle
*Assistant Examiner* — Danielle M. Christensen
(74) *Attorney, Agent, or Firm* — Bookoff McAndrews, PLLC

(57) ABSTRACT

Aviation turbine blade (10) extending in the radial direction from a blade root (14) as far as an upper partition wall (26), said blade (10) comprising a plurality of inner cavities (C1-C10) defining at least one cooling circuit, each of said inner cavities (C1-C10) being defined by walls among inner walls (40, 42), a lower surface wall (22), an upper surface wall (24), the blade root (14) and the upper partition wall (26), said blade (10) being characterized in that it comprises at least one reinforcing beam (50, 60) disposed inside one of the inner cavities (C3, C8), and connecting the blade root (14) to the upper partition wall (26), said reinforcing beam
(Continued)

(50, 60) is not connected to the inner walls (40, 42), the lower surface wall (22) and the upper surface wall (24).

4 Claims, 3 Drawing Sheets

(56) References Cited

U.S. PATENT DOCUMENTS

| | | | | |
|---|---|---|---|---|
| 4,526,512 | A | 7/1985 | Hook | |
| 6,193,465 | B1 | 2/2001 | Liotta et al. | |
| 7,967,565 | B1 | 6/2011 | Kimmel et al. | |
| 8,033,790 | B2 * | 10/2011 | Vance | F01D 5/28 416/97 R |
| 8,485,787 | B2 * | 7/2013 | Marra | B23K 20/023 416/233 |
| 10,781,699 | B2 * | 9/2020 | Negulescu | F01D 5/189 |
| 2006/0120869 | A1 | 6/2006 | Wilson et al. | |
| 2008/0310965 | A1 | 12/2008 | Gerakis et al. | |
| 2010/0080687 | A1 | 4/2010 | Vance | |

FOREIGN PATENT DOCUMENTS

| | | | |
|---|---|---|---|
| EP | 1741875 | A1 | 1/2007 |
| EP | 1947295 | A1 | 7/2008 |
| FR | 2205097 | A5 | 5/1974 |
| GB | 960071 | A | 6/1964 |
| JP | 2011111946 | A | 6/2011 |
| JP | 2012246785 | A | 12/2012 |

OTHER PUBLICATIONS

Search Report issued in Chinese Application CN2018800241894 dated Sep. 29, 2021 (3 pages).

* cited by examiner

TURBINE BLADE HAVING AN IMPROVED STRUCTURE

CROSS-REFERENCE TO RELATED APPLICATIONS

This application is the U.S. national phase entry under 35 U.S.C. § 371 of International Application No. PCT/FR2018/000080, filed on Apr. 10, 2018, which claims priority to French Patent Application No. 1700389, filed on Apr. 10, 2017.

FIELD OF THE INVENTION

The present invention relates to the field of high pressure aviation gas turbine blades, more particularly to the inner structure of these blades, and a gas turbine including blades of this type.

STATE OF THE PRIOR ART

The movable blades of a gas turbine of an airplane engine, and particularly of the high pressure turbine, are subjected to the very high temperatures of the combustion gases during the operation of the engine. These temperatures reach values which are considerably higher than those which the different parts which are in contact with these gases can endure without damage, which has the consequence of limiting their lifetime.

Moreover, an increase in the temperature of the high pressure turbine gasses allows an improvement in the efficiency of an engine, hence the ratio between the thrust of the engine and the weight of an airplane propelled by this engine. Consequently, efforts are made in order to achieve turbine blades which can resist ever greater temperatures, and in order to optimize the cooling of these blades.

Thus it is known to equip these blades with cooling circuits aspiring to reduce the temperature of the latter. Thanks to circuits of this type, the cooling air (or "cold" air) which is generally introduced into the blade through its root, passes through it by following a path formed by cavities provided in the thickness of the blade before being ejected through openings opening on the surface of the blade.

Cooling circuits of this type are called "advanced" when they are composed of several independent cavities in the thickness of the blade, or when some of these cavities are dedicated to localized cooling. These cavities allow defining a blade compatible with the performance requirements of the engines and the lifetime of the parts. As an example of an advanced cooling circuit, the cooling circuit as presented in EP 1741875 can be mentioned.

Advanced circuits of this type have the disadvantage of generating a large difference in temperature between the outer walls of the blade in contact with the stream and the walls in the core of the blade. These large differences in temperature induce dilations and forces which can endanger the mechanical strength of the blade during operation and thus impact its lifetime. The dilations of the walls in the ortho-radial plane generate, in particular, forces around the junction zones between the core of the blade and the walls of the blade, which can cause a break.

The solutions proposed to respond to these problems consist of increasing the thickness of different walls in order to improve their strength. It is well understood, however, that this penalizes the general performance of the blade.

PRESENTATION OF THE INVENTION

The present disclosure relates to an aviation turbine blade extending in the radial direction from a blade root as far as an upper partition wall, said blade comprising a plurality of inner cavities defining at least one cooling circuit, each of said inner cavities being defined by walls among inner walls, a lower surface wall, an upper surface wall, the blade root and the upper partition wall, said blade being characterized in that it comprises at least one reinforcing beam disposed inside one of said inner cavities, and connecting the blade root to the upper partition wall, said reinforcing beam not being connected to the inner walls, the lower surface wall and the upper surface wall.

According to one example, said blade comprises a reinforcing beam disposed in an inner cavity extending from the lower surface wall as far as the upper surface wall.

According to one example, said reinforcing beam is hollow. Said reinforcing beam then typically has slots and/or holes.

According to one example, said beam is centered on a median section of the blade according to a section view in the radial direction.

According to one example, said blade comprises two reinforcing beams disposed in two distinct inner cavities.

The present disclosure also relates to a gas turbine including blades according to the present disclosure.

BRIEF DESCRIPTION OF THE DRAWINGS

The invention and its advantages will be better understood upon reading the detailed description given hereafter of different embodiments of the invention given by way of non-limiting examples. This description refers to the appended pages of figures, in which.

In all the figures, the common elements are identified by identical numerical labels.

DETAILED DESCRIPTION OF EXEMPLARY EMBODIMENTS

Figure 1:
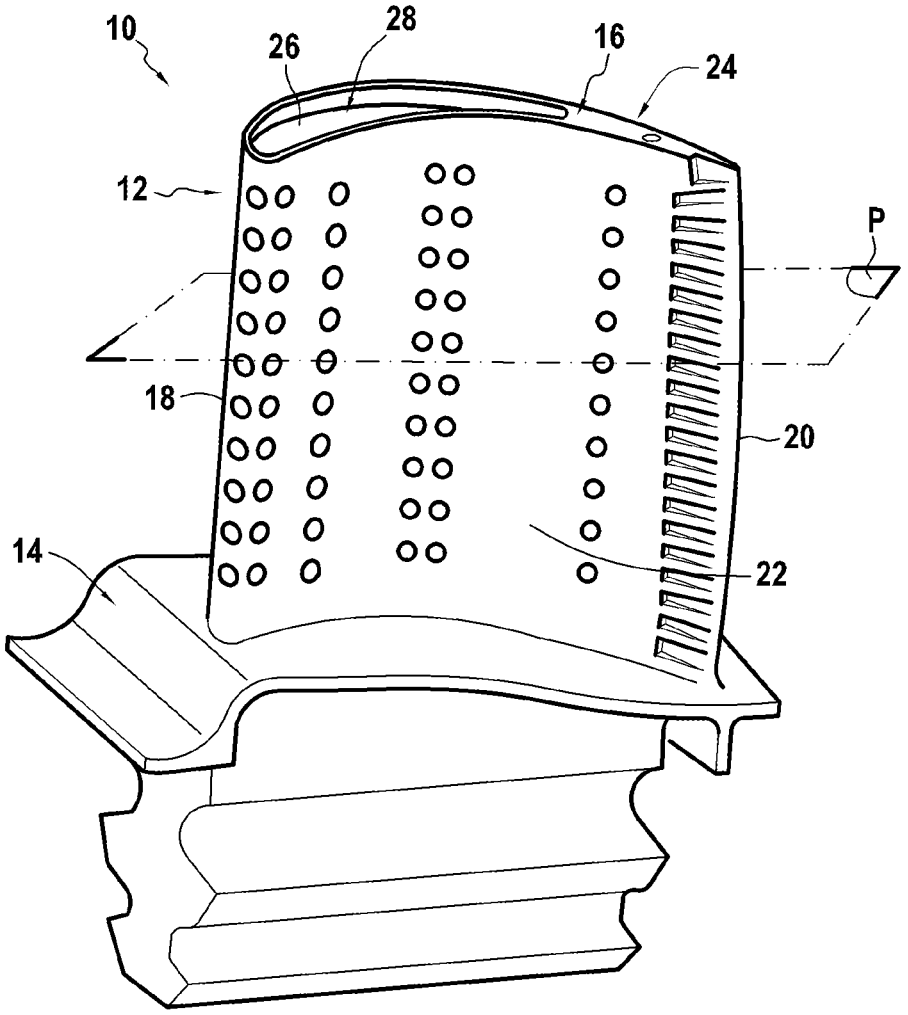
FIG. 1 shows a perspective view of a turbine blade according to the present invention.
Figure 2:
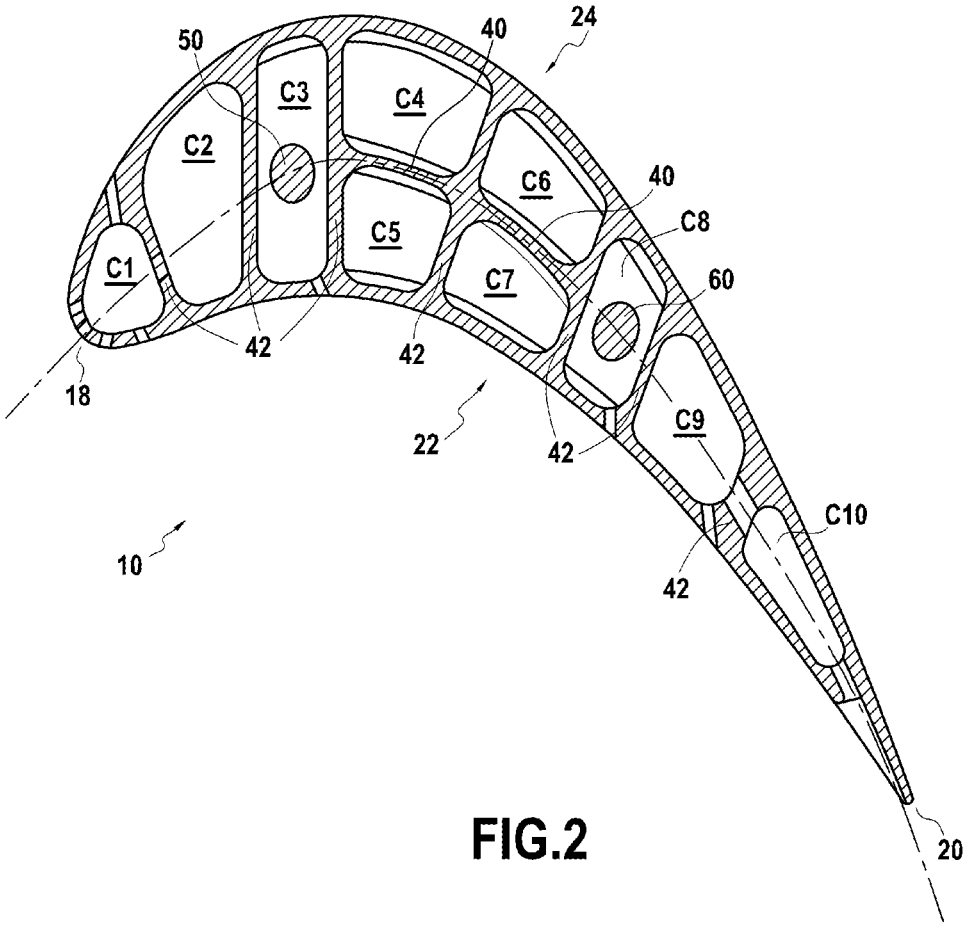
FIG. 2 is a section view of a blade of this type.
Figure 3:
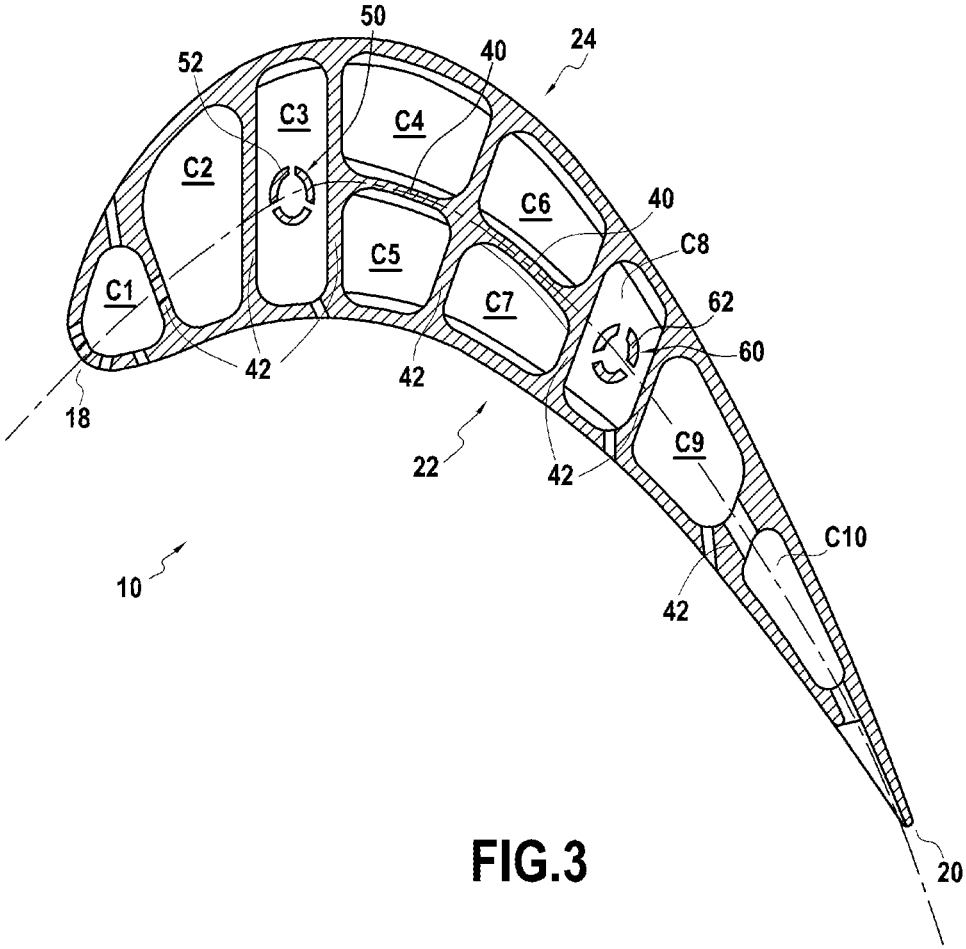
FIG. 3 is a section view of another embodiment of a blade of this type.

The invention is described hereafter with reference to FIGS. 1 to 3.

FIG. 1 illustrates a movable blade 10, metal for example, of a turbine engine high pressure turbine. Of course, the present invention can also apply to other movable or fixed blades of the turbine engine.

The blade 10 includes an aerodynamic surface 12 (or airfoil) which extends radially between a blade root 14 and a blade tip 16.

The blade root 14 is adapted to be mounted on a rotor disk of the high pressure turbine, the blade tip 16 being radially opposite the blade root 14.

The aerodynamic surface 12 has four distinct zones: a leading edge 18 disposed facing the flow of hot gases originating in the combustion chamber of the turbine engine, a trailing edge 20 opposite to the leading edge 18, a lower surface wall 22 and an upper surface wall 24, these lower 22 and upper 24 walls connecting the leading edge 18 to the trailing edge 20.

At the blade tip 16, the aerodynamic surface 12 of the blade is closed by a transverse wall 26. Moreover, the aerodynamic surface 12 extends radially slightly beyond this transverse wall 26 so as to form a trough 28, called hereafter the blade squealer tip. This squealer tip 28 therefore has a bottom formed by the transverse wall 26, an edge formed by the airfoil 12 and it is open toward the blade tip 16.

The blade 10 typically comprises one or more cooling circuits formed by the inner structure of the blade 10 which is described hereafter.

FIGS. 2 and 3 are two section views of two variants of a blade as shown in FIG. 1 along the section plane P as can be seen in FIG. 1.

As can be seen in these figures, the blade 10 is hollow, and its inner volume is composed of a plurality of inner cavities separated by inner walls of the blade 10.

In the examples shown in these figures, the blade 10 comprises 10 inner cavities designated by labels C1 to C10.

As can be seen in the figures for the example shown, a portion of these inner cavities, in this case the inner cavities C2, C3, C8, C9 and C10 extend between the lower surface wall 22 and the upper surface wall 24. Each of the remaining inner cavities, namely the inner cavities C4 to C7, extends between one or the other of the lower surface wall 22 and the upper surface wall 24 and a central inner wall 40. Transverse inner walls 42 extending between the lower surface wall 22 and the upper surface wall 24 allow the different inner cavities to be separated. It is clearly understood that an example of the inner structure of the blade 10 of this type is only illustrative, and that the invention presented can apply regardless of the inner structure of the blade 10.

As indicated in the preamble of the present patent application, one of the major problem sets for the design of a blade 10 of this type relates to the strength during operation, particularly due to the dilation divergences occurring in the different regions of the blade 10, and more precisely the forces resulting from it in an ortho-radial plane of the blade 10.

The blade 10 as proposed comprises one or more reinforcing beams extending inside the inner cavities of the blade 10, from the blade 10 root as for as its upper partition wall, typically the transverse wall 26 defining the bottom of the squealer tip 28 of the blade 10.

In the example shown in FIG. 2, the blade 10 comprises two reinforcing beams 50 and 60 disposed inside the inner cavities C3 and C8 respectively.

Each of these reinforcing beams 50 and 60 extends from the blade 10 root as far as its upper partition wall, and is disposed inside an inner cavity, while remaining unconnected to the lower surface wall 22, the upper surface wall 24 and the inner walls 40 and 42.

Each of the reinforcing beams 50 and 60 is thus situated entirely in a cooling stream of the blade 10, and are therefore at the temperature of the air circulating in the cooling stream considered, and are therefore not impacted directly by the temperature of the lower surface wall 22 and of the upper surface wall 24. The blade root is in fact situated below the air stream, and operates at the temperature of the cooling air of the blade 10.

The presence of reinforcing beams of this type 50 and 60 thus allows holding back the centrifugal force without generating forces in the ortho-radial plane. To the extent that the reinforcing beams 50 and 60 hold back the centrifugal force, the other walls of the blade 10 can be made thinner, which thus allows minimizing, even eliminating, the impact of the reinforcing beams on the weight of the blade 10 and on its cooling circuit.

The reinforcement beams 50 and 60 are typically centered on a median line of the blade 10 according to a section view in the radial direction, as can be seen in FIGS. 2 and 3, which improves the taking up of the centrifugal force by the reinforcing beams 50 and 60.

The number and the placement of the reinforcing beams can vary according to the geometry of the blade 10 and according to the conditions in which it is intended to operate. It is clearly understood in fact that the embodiment shown in FIG. 2, which comprises two reinforcing beams, is not limiting, and that the blade 10 can include a single reinforcing beam, or even 3, 4, 5 or more than 5 reinforcing beams disposed in distinct inner cavities, or several reinforcing beams which can be disposed inside the same inner cavity.

The reinforcing beams can be solid or hollow. FIG. 2 shows an embodiment in which the reinforcing beams 50 and 60 are solid, and FIG. 3 shows an embodiment in which the reinforcing beams 50 and 60 are hollow.

In the case where the reinforcing beams are hollow, they can have bores taking the form of slots and/or holes thus allowing air circulation to be achieved inside the reinforcing beams, for example to define a stream of cooling fluid which must be routed to a critical zone of the blade 10 to the extent that a flow of this kind is thermally insulated with respect to the lower surface wall 22 and the upper surface wall 24. Bores carried out in the reinforcing beams 50 and 60 are identified by numerical labels 52 and 62 respectively in FIG. 3.

The reinforcing beams typically have a circular, oval or ovoid cross section, it being understood that in the case of a blade 10 having several reinforcing beams, these can have distinct geometries. The reinforcing beams can moreover have a constant or variable cross section over the height of the blade 10.

The blade 10 as proposed thus allows combining the advantages linked to a circuit having several cavities in the thickness of the blade without generating forces in the ortho-radial plane, which usually appear in such circuits due to fact of the divergences in dilation between the different walls of the blade 10.

Although the present invention has been described by referring to specific exemplary embodiments, it is clear that modifications and changes can be performed on these examples without departing from the general scope of the invention as defined by the claims. In particular, the number of cooling circuits and of cavities composing each of these circuits is not limited to those shown in this example. Consequently, the description and the drawings must be considered in an illustrative, rather than a restrictive sense.

It is also clear that all the features described with reference to a method are transposable, alone or in combination, to a device, and conversely, all the features described with reference to a device are transposable, alone or in combination, to a method.

The invention claimed is:

1. An aviation turbine blade extending in the radial direction from a blade root as far as an upper partition wall, said blade comprising:

a plurality of inner cavities defining at least one cooling circuit, each of said inner cavities being defined by walls among inner walls, a lower surface wall, an upper surface wall, the blade root, and the upper partition wall; and at least two reinforcing beams disposed inside at least two distinct inner cavities of said inner cavities, and connecting the blade root to the upper partition wall, said reinforcing beams not being connected to the inner walls, the lower surface wall and the upper surface wall, wherein said reinforcing beams are hollow and have slots and/or holes, and wherein said reinforcing beams hold back a centrifugal force without generating a force in an ortho-radial plane of the aviation turbine blade.

2. The blade according to claim 1, wherein said at least two reinforcing beams each comprise a reinforcing beam disposed in a respective inner cavity of said at least two inner cavities, each inner cavity extending from the lower surface wall as far as the upper surface wall.

3. The blade according to claim 1, wherein said at least two reinforcing beams are each centered on a median section of the blade according to a section view in a radial direction.

4. A gas turbine including blades according to claim 1.

* * * * *